United States Patent [19]

Marzoli

[11] Patent Number: 4,777,792

[45] Date of Patent: Oct. 18, 1988

[54] GRIPPING DEVICE FOR TUBES OR THE LIKE, FOR APPARATUS FOR AUTOMATICALLY REPLACING THESE IN TEXTILE MACHINES

[75] Inventor: Pietro B. Marzoli, Bergamo, Italy

[73] Assignee: Fratelli Marzoli & C. S.p.A., Italy

[21] Appl. No.: 7,513

[22] Filed: Jan. 28, 1987

[30] Foreign Application Priority Data

Jan. 28, 1986 [IT] Italy ..... 19200 A/86

[51] Int. Cl.[4] ..... D01H 9/04; B66C 1/46

[52] U.S. Cl. ..... 57/275; 57/267; 57/274; 294/93; 294/98.1

[58] Field of Search ..... 57/275, 266, 267, 274; 294/86.12, 88, 86.15, 93, 86.32, 98.1, 99.1, 169, 902

[56] References Cited

U.S. PATENT DOCUMENTS

| | | | |
|---|---|---|---|
| 2,962,856 | 12/1960 | Ingham, Jr. | 57/275 |
| 3,462,934 | 8/1969 | Schulz et al. | 57/275 |
| 3,599,413 | 8/1971 | Nimtz et al. | 57/275 X |
| 3,633,959 | 1/1972 | McCollough | 57/275 X |
| 3,835,633 | 9/1974 | Klein | 57/275 |
| 3,895,482 | 7/1975 | Schulz et al. | 57/275 |
| 4,472,934 | 9/1984 | Kriechbaum et al. | 57/275 |

*Primary Examiner*—John Petrakes

*Attorney, Agent, or Firm*—Diller, Ramik & Wight

[57] ABSTRACT

The gripping device comprises at least one gripper which can be inserted into the tube and is formed from two elements which are mobile axially one in the other and are provided with frusto-conical ends which cooperate in such a manner that the axial movement of the inner element causes the outer element to expand and to engage under pressure with the tube for the purpose of its replacement. Two friction discs supported in an axially mobile manner are associated with the gripper and are subjected to the action of a spring in order to press a lower support element of the discs against the tube in order to retain it and allow exact keying of the tube on to the rotary drive element. The device is particularly suitable for cops.

20 Claims, 2 Drawing Sheets

GRIPPING DEVICE FOR TUBES OR THE LIKE, FOR APPARATUS FOR AUTOMATICALLY REPLACING THESE IN TEXTILE MACHINES

This invention relates to a gripping device for tubes or the like, for apparatus for automatically replacing these in textile machines, in particular roving frames.

The term "tube" signifies herein any hollow element on which determined quantities of yarn are wound, and thus cops and the like.

Spinning machines (roving frames and spinning frames) and twisting machines are frequently equipped with tube replacement apparatus, which automatically replace with empty tubes those tubes which have been filled with yarn or roving which has been wound thereon by means of flyers or slide rings. Such apparatus are provided with gripping devices known as "grippers", for gripping and retaining the tubes during the replacement operation. Said devices are generally mounted on a gripper support, to which a control and operating mechanism transmits the movements necessary for replacing the tubes.

Gripping devices are known, such as that described in U.S. Pat. No. 3,714,770, in which the gripper, of male form, is partly inserted into a tube to be gripped, and comprises a bellows which projects from the respective support element and is provided with a flexible wall which is expanded by a pressurised fluid fed into the bellows, until it becomes clamped against the inner wall of the tube.

These devices are particularly suitable for frusto-conical tubes, and thus for spinning frames in which the gross weight of the yarn plus tube does not exceed 250 grams. They are not suitable for cops obtained from a roving frame, in which the tubes are of cylindrical form with the insertion bore also of cylindrical form and having a diameter less than the diameter of the tube body. Moreover, in these cases the gross weight of the roving plus tube exceeds 3000 grams, and thus high-pressure fluid has to be fed into the relative grippers, which have to use materials for the flexible wall which are resistant both to high stress and to wear, with considerable cost increase. Particularly suitable for roving frames is however a gripping device described in U.S. Pat. No. 4,369,621 in which the gripper is in the form of a fork for gripping the tubes.

This gripper however requires the use of special tubes, the top of which is provided with a projection to allow gripping by the gripper fork. This is a serious drawback, because the use of special tubes instead of normal tubes leads to high cost. Furthermore, as is known to experts in the textile field, the tubes for roving frames have one or more seats in their base for engagement with a drive key mounted on the cop rotator for rotating the relative tube, this being necessary for winding the roving on to the tube. It can happen that in replacing a tube full of roving with an empty tube, the seats of this latter do not coincide with the drive key. Known grippers are not able to position the tubes such as to always make said seats coincide with the key, so that difficulties can arise for example on starting the machine, in that those tubes which are not keyed undergo vibration and the roving attachment does not take place at the same point for all the tubes, with problems on rewinding and with continuous machine stoppages and thus yield reduction. The object of the present invention is to provide a gripping device with which the drawbacks of known devices are obviated, and which when used on automatic tube replacement apparatus in roving machines satisfies the inherent requirements of such apparatus. This means that a gripping device for tubes or the like is to be provided which does not require the use of special tubes and which is of reliable operation and able to grip cops of considerable weight, while ensuring during their replacement with empty tubes that the said tubes are perfectly engaged with the drive key to allow proper starting and proper operation during the winding of the roving or yarn thereon.

The aforesaid problems are solved according to the invention by a gripping device for tubes or the like for apparatus for automatically replacing these in textile machines, comprising at least one gripper which can be inserted into the tube or the like to be replaced and is carried by a mobile gripper carrier for conveying the tube or the like during the replacement stage, the gripper comprising an element for gripping the tube or the like which can be expanded by the action of a pressurised fluid, characterised in that friction menas supported such that they are axially mobile relative to the gripper are associated with the gripper, and are subjected to the action of an elastic means acting in a direction towards the gripping end of the gripper in order to key the tube or the like on to a rotary drive element. In a preferred embodiment, the gripper consists of a rigid central element of cylindrical shape with its lower end of frusto-conical shape, and an expandable element preferably of plastics material having a hollow cylindrical shape and a lower end which is internally of frusto-conical shape, the expandable element being freely mounted on the central element and fixed on to an element which can be centered in a horizontal plane, this latter element being mounted on a gripper carrier plate. The upper end of the central element of the gripper can be connected, by a hinge of horizontal axis, to a pneumatic cylinder in order to extract the tubes full of yarn and to place the empty tubes in their working position.

Further characteristics and details of the invention will be apparent from the description given hereinfater with reference to the accompanying drawings, it being however understood that the invention can also be implemented in numerous other forms.

Figure 1:
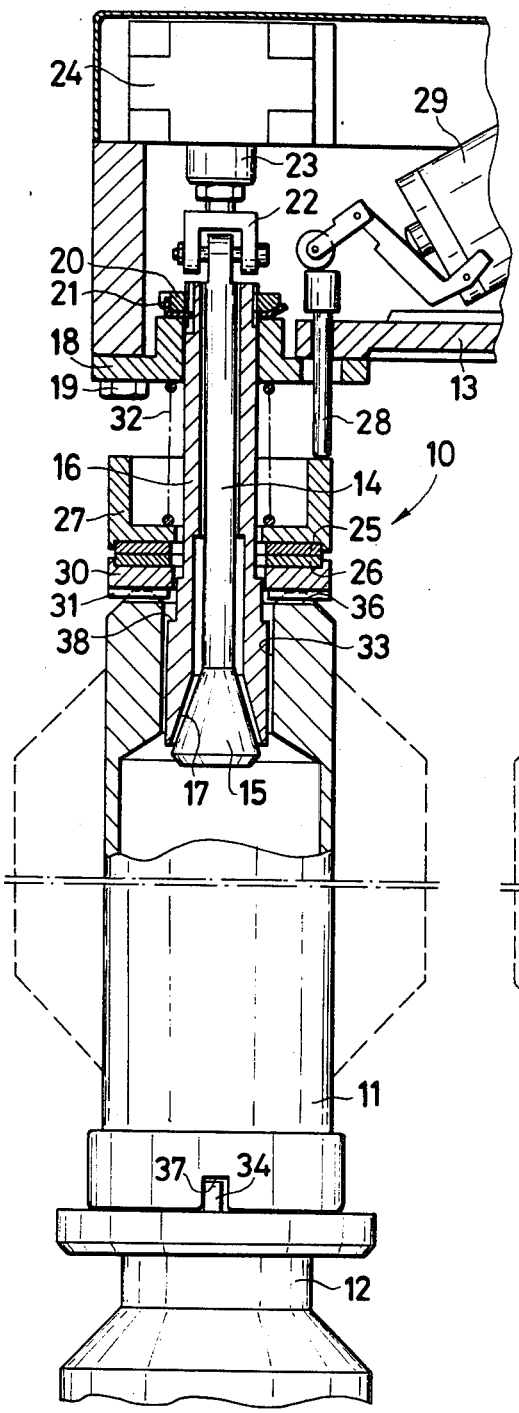
FIG. 1 is a partial cross-section through one embodiment of the invention, in which the gripping device has already been inserted into the tube to be removed.

A gripping device 10 according to the invention, and shown in the figures, serves for gripping the cylindrical tubes of textile machines, preferably roving frames. These gripping devices are used in tube replacement apparatus, in which the tubes 11, situated on rotary drive elements 12 in the form of cop rotators in one or more rows, are gripped by said gripping elements 10 after the roving has been wound, and are withdrawn from the cop rotators 12 by a determined movement of a gripper carrier element 13 which supports the devices 10 and are conveyed into a storage position. Said gripping devices 10 are then advantageously used for gripping the empty tubes, which are then placed on the cop rotators 12 by corresponding movements of the element 13. One or more of these devices 10, which are operated together, are generally disposed on the element 13. Tube replacement apparatus of this kind are already known, and are therefore not further described herein.

The gripping device 10 comprises a substantially cylindrical central steel element 14 which has its lower end 15 of frusto-conical shape and is free to slide axially in a substantially hollow cylindrical gripping element 16 of plastics material which at its bottom has its inner wall 17 of frusto-conical shape conjugate with that of the end 15 of the element 14. The element 16 is mounted on a flange 18, which by means of a shoulder screw 19 (only the head of the screw can be seen in the figures) is fixed on to the gripper carrier element 13.

Between the shoulder screw 19 and the bore in the flange 18 through which the screw is inserted there is a certain play, so that the assembly formed from the flange 18 and elements 14, 15 and 16 can be adjusted in a horizontal plane such that the axis of the gripping device 10 coincides with that of the tube 11. To enable the element 16 to be more firmly held on the flange 18, the upper end of the element 16 is threaded in order to receive a ring nut 20 and the relative washer 21.

Figure 4:
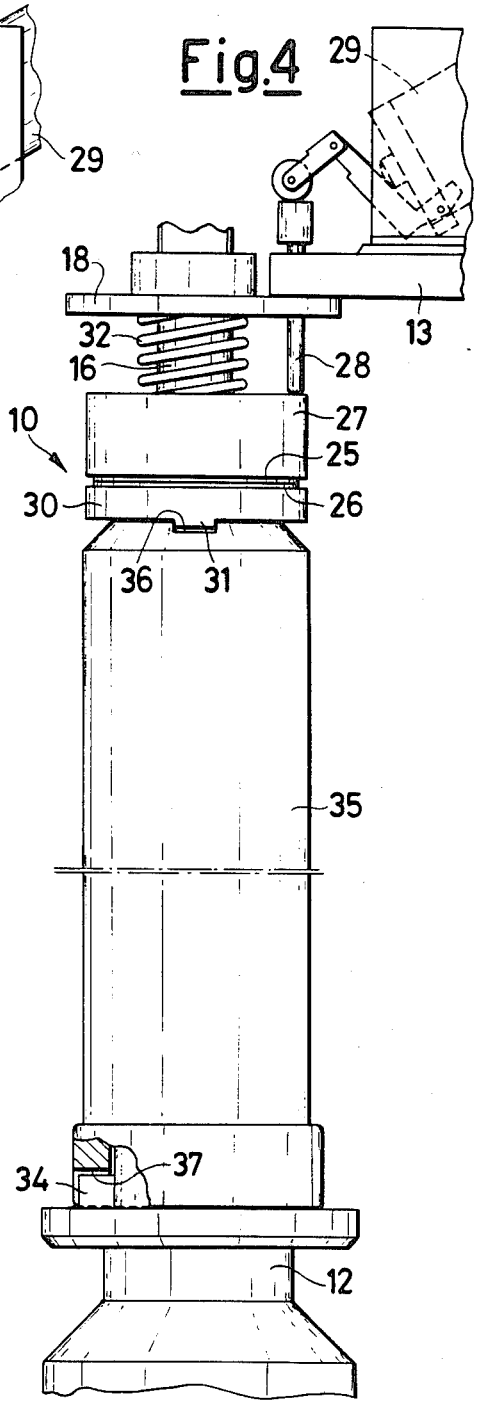
FIG. 4 is a side view in which the empty tube has been placed with its seats engaged with the drive element.

The upper end of the central element 14 is connected by a hinge 22 of horizontal axis to a piston 23 forming part of a hydraulic cylinder 24, in particlar a pneumatic cylinder. On the outside of the hollow element 16 there are fitted two friction discs 25 and 26 which are mounted so that they respectively face a hollow support element 27 having a rod 28 the upper end of which touches a microswitch 29, and a support element 30 having a lower projection 31 (FIGS. 4 and 5). The elements 27 and 28 are free to slide axially on the element 16 and are subjected to the action of a spiral spring 32 which puts the discs 25 and 26 under compressive stress in order, after replacing the tube full of roving, to properly key the empty tube on to the cop rotator 12, as described hereinafter.

A step 38 provided on the outside of the gripping element 16 defines a travel limit stop for the friction means 25, 26 when the gripper 10 is not inserted into the tube 11. The operation of the described device is as follows. Only one gripping device 10 will be considered for simplicity, without however this limiting the invention in that, as specified in the introduction, a plurality of such devices can be provided, their maximum number being equal to the number of working positions on a machine.

Figure 2:
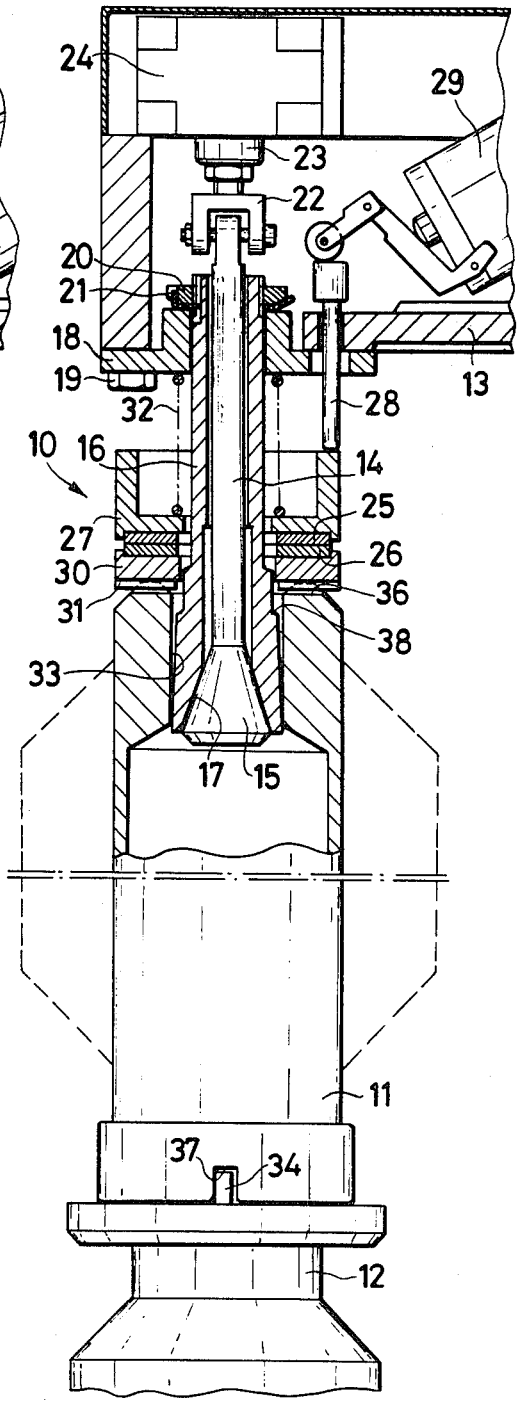
FIG. 2 is a partial cross-section in which the gripping device has gripped the tube, which is ready for removal.

When the tube 11 is full of roving, the cop rotator 12 stops. The element 13 carrying the gripping device 10 is lowered so that the gripper formed from the elements 14 and 16 becomes inserted into the insertion bore 33 in the underlying tube 11 (FIG. 1). A pressurised fluid is then fed into the cylinder 24 so that the piston 23 moves upwards, with the result that the element 14 also moves upwards so that the lower end 15 of the element 14 comes into engagement with the end 17 of the element 10 which is at rest. The element 16 expands, and its outer wall clamps against the wall of the insertion bore 33 in the tube 11 (FIG. 2). After clamping, the gripper carrier element 13 is raised, with the result that the clamped tube 11 disengages from the drive key 34 of the cop rotator 12, and is conveyed by an automatic apparatus (not shown) into the cop storage position, the pressure then being released from the cylinder 24 so that the tube 11 full of roving is left in said store. The gripper carrier element 13 is moved into the position corresponding to the store of empty tubes, and the gripper 10 is automatically inserted here into an empty tube 35, is made to engage with it and is then conveyed on to the cop rotator 12.

If the seat 37 of the tube 35 does not immediately fit on to the drive key 34 of the cop rotator 12 (FIG. 3), the following happens. The empty tube 35, released from the gripping device 10, which remains in contact with it, is rotated by the cop rotator 12 until the projection 31 of the element 30 finds the upper seat 36 of the tube 35, with the result that the tube becomes keyed at its top to thus remain braked.

The cop rotator 12 then rotates whereas the tube 35 remains at rest, and this enables the drive key 34 to engage in the lower seats 37 of the tube 35 (FIG. 4). The tube 35, now keyed, can rotate together with the cop rotator 12, as the discs 25 and 26 slip to allow this rotation. The rod 28 situated on the element 27 lowers the microswitch 29, which feeds an enabling signal to a solenoid valve (not shown as it does not form part of the invention) for raising the element 13 and with it the gripping device 10, with the result that the machine recommences its normal spinning.

It should be noted that even if the tube 35 was not rotated by the cop rotator 12 while disengaged from the key 34, but remained at rest because of prevalent braking action of the tooth 31 and friction means 25, 26, engagement with the key 34 would in any case take place by virtue of the rotation thereof.

In a device according to the invention, the presence of the friction means 25, 26, the tooth 31 and the seat 36 therefore result in reliable engagement between the tube 35 and key 34, even in those cases in which the tube 35 rotates with the cop rotator 12 without being engaged by the key 34. It is, therefore, apparent that the arrangement of the friction means 25, 26 and engagement means 31, 36 advantageously solves the double problem of retaining or halting the tube 35 while effecting the driving engagement, but of not hindering this drive when engagement has taken place.

Figure 3:
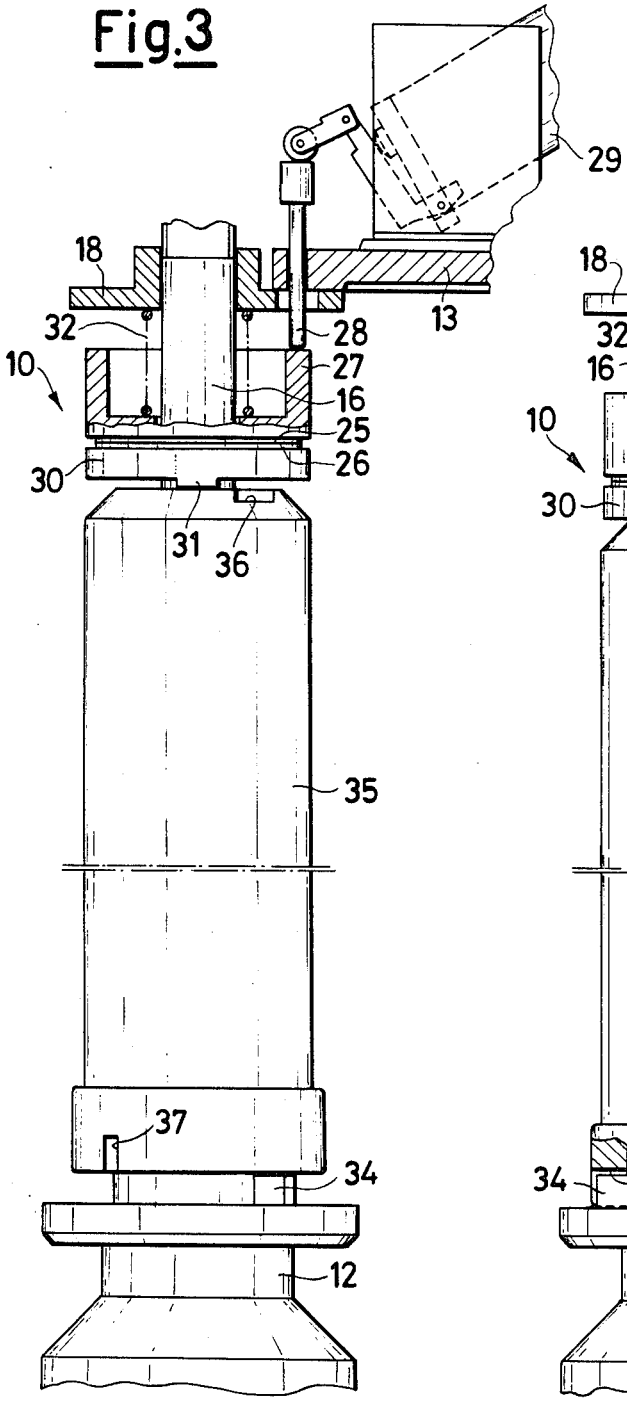
FIG. 3 is a side view of the device in which the seats in the tube which has replaced the full tube are not yet engaged by the drive element.

In this respect, it should be noted that as the spring 32 when in the working position of FIG. 4 is slacker than when in the position of FIG. 3, the friction force between the friction elements, which tends to brake the rotary movement of the tube, is smaller with the result that the braking action is smaller, and is perfectly tolerable for the time necessary for keying all the tubes of a plurality.

I claim:

1. A gripping device particularly adapted for use in textile machines for gripping tubes comprising a carrier, a gripper carried by the carrier, said gripper having an expandable end portion adapted to be inserted into a bore defined by an interior surface of an associated tube particularly during a replacement operation of an associated textile machine, means associated with said gripper expandable end portion for radially outwardly expanding said gripper expandable end portion thereby gripping an associated tube by its interior surface, fluid pressure means for operating said radially outwardly expanding means to thereby expand said gripper expandable end portion, clutch means for selectively slippingly engaging and nonslippingly engaging the tube, said clutch means including a pair of opposing first and second clutch mmbers, first faces of said first and second clutch members being in adjacent opposing relationship to each other, a second face of said first clutch member being in opposing relationship to an associated tube, and elastic means for urging said second clutch member in a first direction toward said first clutch member for effecting the selective slipping and nonslipping engagement of the tube by the first clutch member second face.

2. The gripping device as defined in claim 1 wherein said first and second clutch members include adjacent first and second opposing friction discs at said first clutch members first faces.

3. The gripping device as defined in claim 2 including means for mounting said first and second clutch members for axially sliding movement relative to said gripper expandable end portion.

4. The gripping device as defined in claim 2 including means mounting said friction discs in external telescopic relationship to and for axially sliding movement relative to said gripper expandable end portion.

5. The gripping device as defined in claim 2 wherein said gripper expandable end portion is a sleeve having an internal bore, said radially expanding means includes a rod having an enlarged portion disposed within said sleeve internal bore, and said fluid pressure means is effective for moving said sleeve and rod relative to each other.

6. The gripping device as defined in claim 2 including means mounting said friction discs for axially sliding movement relative to said gripper expandable end portion along a path of travel, and means for adjustably mounting said gripper relative to said carrier along a plane transverse to said path of travel.

7. The gripping device as defined in claim 6 wherein said gripper expandable end portion is a sleeve having an internal bore, said radially expanding means includes a rod having an enlarged portion disposed within said sleeve internal bore, and said fluid pressure means is effective for moving said sleeve and rod relative to each other.

8. The gripping device as defined in claim 1 wherein said first and second clutch members include adjacent first and second opposing friction discs at said first clutch members first faces, and means mounting said friction discs for axially sliding movement relative to said gripper expandable end portion.

9. The gripping device as defined in claim 8 including means for mounting said first and second clutch members for axially sliding movement relative to said gripper expandable end portion.

10. The gripping device as defined in claim 9 wherein said gripper expandable end portion is a sleeve having an internal bore, said radially expanding means includes a rod having an enlarged portion disposed within said sleeve internal bore, and said fluid pressure means is effective for moving said sleeve and rod relative to each other.

11. The gripping device as defined in claim 8 including means mounting said friction discs in external telescopic relationship to and for axially sliding movement relative to said gripper expandable end portion.

12. The gripping device as defined in claim 11 wherein said gripper expandable end portion is a sleeve having an internal bore, said radially expanding means includes a rod having an enlarged portion disposed within said sleeve internal bore, and said fluid pressure means is effective for moving said sleeve and rod relative to each other.

13. The gripping device as defined in claim 1 including means for mounting said first and second clutch members for axially sliding movement relative to said gripper expandable end portion.

14. The gripping device as defined in claim 1 wherein said first and second clutch members include adjacent first and second opposing friction discs at said first clutch members first faces, and means mounting said friction discs in external telescopic relationshipp to and for axially sliding movement relative to said gripper expandable end portion.

15. The gripping device as defined in claim 1 including means for mounting said first and second clutch members for axially sliding telescopic movement relative to said gripper expandable end portion.

16. The gripping device as defined in claim 1 wherein said radially expanding means is positioned internally of said gripper expandable end portion.

17. The gripping device as defined in claim 1 wherein said gripper expandable end portion is a sleeve having an internal bore, said radially expanding means includes a rod having an enlarged portion disposed within said sleeve internal bore, and said fluid pressure means is effective for moving said sleeve and rod relative to each other.

18. The gripping device as defined in claim 1 wherein said first and second clutch members include adjacent first and second opposing friction discs at said first clutch members first faces, means mounting said friction discs for axially sliding movement relative to said gripper expandable end portion along a path of travel, and means for adjustably mounting said gripper relative to said carrier along a plane transverse to said path of travel.

19. The gripping device as defined in claim 1 including means defining a stop for limiting movement of said first clutch member in said first direction when said gripper is not positioned in a tube opening.

20. The gripping device as defined in claim 1 including a tooth carried by said second clutch mmeber second face adapted to engage an associated recess in a tube axial end surface.

* * * * *